US008237038B2

(12) United States Patent
Gauger

(10) Patent No.: US 8,237,038 B2
(45) Date of Patent: Aug. 7, 2012

(54) SUPPORT SYSTEM FOR ACOUSTIC INSTRUMENTS

(76) Inventor: Gary Gauger, Minnetonka, MN (US)

( * ) Notice: Subject to any disclaimer, the term of this patent is extended or adjusted under 35 U.S.C. 154(b) by 0 days.

(21) Appl. No.: 13/116,275

(22) Filed: May 26, 2011

(65) Prior Publication Data

US 2011/0219937 A1 Sep. 15, 2011

Related U.S. Application Data

(63) Continuation of application No. 12/546,607, filed on Aug. 24, 2009, now Pat. No. 7,960,634.

(60) Provisional application No. 61/100,522, filed on Sep. 26, 2008, provisional application No. 61/156,933, filed on Mar. 3, 2009.

(51) Int. Cl.
*G10D 13/02* (2006.01)

(52) U.S. Cl. ..... 84/421; 84/406; 69/19.1; 69/19.3

(58) Field of Classification Search ..... 84/421
See application file for complete search history.

(56) References Cited

U.S. PATENT DOCUMENTS

| | | | | | |
|---|---|---|---|---|---|
| 67,996 | A | * | 8/1867 | Marsh | |
| 484,137 | A | * | 10/1892 | Cauffield | 69/19.3 |
| 2,594,902 | A | * | 4/1952 | Frazier | 69/19.1 |
| 3,191,484 | A | * | 6/1965 | Walling | 84/421 |
| 3,780,613 | A | * | 12/1973 | Ludwig, Jr. | 84/421 |
| 3,859,886 | A | * | 1/1975 | Brisco, Sr. | 84/402 |
| 3,867,863 | A | * | 2/1975 | Vennola et al. | 84/420 |
| 4,154,135 | A | | 5/1979 | Haack | |
| 4,158,980 | A | * | 6/1979 | Gauger | 84/421 |
| 4,335,538 | A | * | 6/1982 | Greenberg | 446/220 |
| 4,441,267 | A | * | 4/1984 | Doss | 38/102.8 |
| 4,519,289 | A | * | 5/1985 | Gauger | 84/421 |
| 4,596,176 | A | * | 6/1986 | Gauger | 84/421 |
| 4,811,576 | A | * | 3/1989 | Davis | 69/19.3 |
| 5,337,645 | A | * | 8/1994 | Johnston | 84/421 |
| 5,404,786 | A | * | 4/1995 | Gatzen | 84/421 |
| 5,600,080 | A | * | 2/1997 | Belli | 84/421 |
| 6,102,358 | A | * | 8/2000 | McLeary | 248/604 |
| D439,502 | S | * | 3/2001 | Shan | D8/354 |
| 7,378,584 | B2 | * | 5/2008 | Frank et al. | 84/411 R |
| 7,645,928 | B2 | * | 1/2010 | Graham et al. | 84/421 |
| 7,906,718 | B1 | * | 3/2011 | Liao | 84/411 R |
| 7,960,634 | B2 | * | 6/2011 | Gauger | 84/421 |

* cited by examiner

*Primary Examiner* — Elvin G Enad
*Assistant Examiner* — Robert W Horn
(74) *Attorney, Agent, or Firm* — Frank Marino

(57) ABSTRACT

A support system for an acoustic instrument has connecting elements of flexible material extending between and attaching the instrument and a support frame to support and/or balance the weight of the instrument and isolate acoustic frequencies, thereby eliminating deleterious acoustical effects. Embodied exemplarily herein as a support system for a drum, flexible elements extend between and attach the drum head hoop to a circular frame or support that fully or partially encircles the drum. The flexible elements may be made integral with the drum head and/or its head skin.

28 Claims, 12 Drawing Sheets

SUPPORT SYSTEM FOR ACOUSTIC INSTRUMENTS

RELATED APPLICATION

This application is a Continuation of and claims the benefit of U.S. non-Provisional application Ser. No. 12/546,607 filed Aug. 24, 2009 now U.S. Pat. No. 7,960,634, and further claims the benefit of U.S. Provisional Applications Ser. No. 61/100,522 filed Sep. 26, 2008, and Ser. No. 61/156,933 filed Mar. 3, 2009, the entire teachings of which are incorporated herein by reference.

FIELD OF THE INVENTION

The present invention is related to acoustic instruments. More specifically, this invention is related to percussion instruments and systems for supporting such instruments. Most specifically, the invention related to a vibration-isolating support system for a drum.

BACKGROUND OF THE INVENTION

From http://en.wikipedia.org/wiki/Drum kit;

A drum kit (also drum set or trap set) is a collection of drums, cymbals and sometimes other percussion instruments, . . . arranged for convenient playing by a single drummer . . . . The exact collection of drum kit components depends on factors like musical style, personal preference, financial resources, and transportation options of the drummer. Cymbal, hi-hat, and tom-tom stands, as well as bass drum pedals and drummer thrones are usually standard. Most mass produced drum kits are sold in one of two 5 piece configurations (referring to the number of drums only) which typically include a bass drum, a snare drum, and three toms. The standard sizes (sometimes called 'rock' sizes) are 22" (head size diameter) bass drum, 14" snare drum, 12" and 13" mounted toms, and a 16" floor tom. The other popular configuration is called Fusion size, a reference to Jazz fusion music, which usually includes a 22" bass drum, a 14" snare drum, and 10", 12" and 14" mounted toms. The standard hardware pack includes a hi hat stand, a snare drum stand, two or three cymbal stands, and a bass drum pedal. Drum kits are usually offered as either complete kits which include drums and hardware, or as "shell packs" which include only the drums and perhaps some tom mounting hardware. Cymbals are usually purchased separately and are also available in either packs or as individual pieces.

An illustration of a typical drum kit is shown in FIG. 24. The kit consists of Bass drum 201, Floor tom 202, Snare 203, toms 204, Hi-hat 205, and Crash and Ride cymbals 206. Floor toms tend to be larger in diameter and longer in length and thus heavier than suspended toms.

Drum mounting is usually done in one of three arrangements. Rack or stand mounted drums typically use a stand that has an upright metal pole or tube attached to a three-legged base, herein referred to as a "tripod stand". This stand usually has two small arms at the top that permit the stand to hold one or two tom drums by various means, using holders that fasten to the drum. These mounts or holders attach to the shell of the drum or, if suspended, attach to a suspension bracket.

Common prior art suspension brackets were die cast or metal and directly affixed to the shell of a drum. Such rigidly connected systems inhibited the ability of the shell to resonate fully with the vibrating drum head, and resulted in adverse acoustical effects.

Most modern drums have wooden shells which may vary in thickness from one-eighth to one-half of an inch. This variation in shell thickness can cause a considerable variation in the weight of the drums, even though they may have identical diameters and heights. For example, a thirteen-inch diameter by nine-inch tall drum with a three-sixteenths-inch thick shell may weigh approximately eight pounds, while a thirteen-inch diameter by nine-inch tall drum with a one-half-inch thick shell may weigh approximately twelve pounds. Some shells are made of plastic or fiberglass, which have even greater weight. And some shells are made of composites such as carbon fiber which results in a very light shell.

Drums are typically manufactured in standard diameters of eight, ten, twelve, thirteen, fourteen, fifteen, sixteen, and eighteen inches. Drum heights vary significantly, but when intended for rack-mounting, the heights are typically less than the diameters. Drums having a height as long or longer than the diameter, such as fourteen-by-fourteen, sixteen-by-sixteen, or eighteen-by-eighteen, are typically set on the floor since they are too heavy to be practical for rack mounting (See item 22 of FIG. 24 as an example).

Another alternative (not shown) uses a three-legged base attached to an upright pole that has three arms that extend from the top. A mechanical means such as a screw projects up through the center of the three arms and is designed to adjust the arms in or out by rotating the screw through the handle or knob attached to the end of the screw. This action creates a 'clamping' force to the bottom hoop of the drum. The arms are usually spaced equally apart at about one-hundred and twenty angular degrees.

Some prior art drum mounting systems, such as those demonstrated in the present inventor's U.S. Pat. No. 4,158,980, included an arcuate frame structure that was slightly larger than the radius of the drum, and extended one hundred and eighty angular degrees or more around the drum shell. Such mounting systems eliminated the commonly employed bracket from the shell and instead incorporated a support that was affixed to the frame encircling the drum. The arcuate frame was attached to the drum's tuning rods using vibration dampening grommets. Such systems attempted to prevent the resonance of the drum from being choked or dampened by the mounting system, thereby attempting to prevent the aforementioned adverse acoustical effects.

Such a system as those demonstrated in U.S. Pat. No. 4,158,980 typically employed three or more metal L-shaped brackets extended from the frame and attached to the tuning rods. This change demonstrated a dramatic and very noticeable improvement over the common mounting systems precedent thereto in tonal quality, frequency range and overall resonance of the instrument, since the shell was now able to act unrestricted and in concert with the vibrating drum head. This structure worked very well as long as the drum was positioned perpendicular to the ground or with the drum head being parallel to the floor. The weight loading of the drum in this position placed the center of gravity in the center of the drum therefore dividing the weight of the instrument evenly among the L-shaped brackets in the contact areas around the drum's radius.

However, such systems as those demonstrated in U.S. Pat. No. 4,158,980 were deficient when the drum was angled or tilted into a common playing position as required by most players of the instrument. This changes the center of gravity, thereby shifting the weight loading on the L-shaped brackets unevenly about the drum. Depending on the amount of angle, the increase or decrease in the shifting weight at these points can be substantial and change the pressure against the shell. When the drum was level or in plane with the floor the weight was evenly distributed with the load being directed straight down or perpendicular to the floor at all attachment points, but as the drum was tilted, greater pressures against the shell created a damping effect by preventing the shell from vibrating.

To hold or suspend a drum or any vibrating object without interfering with its resonance is a function of balance. When a drum vibrates along with the head, it becomes a vibrating entity. Every part of the drum wants to vibrate freely. If the drum or any part of it is restricted by pressure against any part of its structure, it will affect the resonance and therefore part of its frequency response. This change can occur from even slight pressure or change in pressure to any part of the drum. This characteristic along with the variations from one drum to another can produce an infinite number of results when it comes to problems and solutions in drum vibration.

The more extreme the angle of drum tilt, the greater the pressure against the shell, and the more damping would occur in such systems, especially at the lower part of the angled drum. The upper side of the tilted drum would then realize less weight, creating less pressure against the shell. As the angle of the drum was increased, the function or ability of the rubber grommets to isolate resonance would be diminished and the grommets would change more to absorbing resonance, which is determined by the weight load shift occurring at the points of contact. The rubber isolation grommets would now be dampening resonance in the contact areas of greater weight due to the shifting balance. In fact, as an admission of this, U.S. Pat. No. 4,158,980 refers to the grommets as "vibration absorbing means". The tilted drum would now begin to show a noticeable decrease in tonal quality and resonance due to the change in the drum's center of gravity.

When commercialized, such rubber grommets were typically made from mixing rubber compounds to soften or harden the material, altering its durometer or hardness. By mixing rubber compounds to create different durometers, it was possible to isolate specific frequencies. In practice, the grommets were typically made of a mid-range durometer, since most drums can be tuned to a wide range of frequencies. Providing the drummer with a variety of grommets to change according to the tuning of the drum and thereby isolate the tuned frequencies was not practical, for many obvious reasons, and would not be effective even if practical, since shifting of the center of gravity whenever the drum's tilt angle was changed would alter the grommet's ability to function properly anyway.

A drum head typically contains three basic components; a head skin (usually made of polyethylene-terephthalate or an equivalent material in modern drums), a hoop (usually made of aluminum), and some type of glue or adhesive (usually epoxy resin) to attach or fasten the skin in or to the hoop. This type of head is the most common and is known as a chemically-bonded head because of the glue or chemicals used in its fabrication. Another type of head uses only two basic components in its structure. This is a called mechanical head because the skin is crimped or clamped inside the aluminum hoop and thereby affixed thereto by mechanical means. Either of these types of heads may be employed within the present invention.

When the drum head is placed on the top or bottom of the drum shell it becomes contoured over the bearing upper edge of the shell and the hoop extends around and beyond the edge, leaving a very slight gap or overhang between the outside of the shell and the drum head hoop. This is important, because only the head's skin should be touching the bearing edge of the shell. This bearing edge is similar to the bridge on a string bass or violin. It creates a stopping point for the drum head from where its vibration begins (or ends). It also creates a firm surface that allows the resonance of the vibrating head to transfer to the drum shell.

The hoop part of the drum head is actually isolated from the vibration of the head by the bearing edge contact. A counter hoop, usually die cast of aluminum or stamped from steel, is placed over the drum head to create a means for changing the tension or pitch of the drum head. Threaded tension rods are used around the counter hoop to pull the head skin and hoop down over the bearing edge, thus tightening the skin across the top or bottom of the drum. The tension rods additionally allow tuning of the drum by increasing tension on the head skin when tightened and reducing such tension when loosen. A tighter head skin will have higher resonant frequencies than an otherwise equivalent but looser head skin.

Another drawback of the mounting system demonstrated in U.S. Pat. No. 4,158,980 is that the attachment points of the mounting frame are located at four or more tension rods. Resonance that comes from the vibrating shell after the drum head is struck transfers through the metal castings that attach to the shell surrounding the drum, creating additional adverse acoustical effects.

SUMMARY OF THE INVENTION

The present invention may be embodied as a drum-mounting suspension system that provides substantial and unique improvements to previous drum-mounting systems, such as those demonstrated in the present inventor's U.S. Pat. No. 4,158,980. The improvements are based on continued experimentation with drums and acoustic instruments and principles of resonance discovered over many years of research. The limitations of previous systems along with new findings concerning drum shell resonance and isolation will be explained in and understood by the forgoing description of an exemplary embodiment for employing the invention.

The invention may lie in a suspension system for an acoustic instrument, including a percussion instrument such as a drum, a cymbal, or a cello. The invention is useful with any instrument that depends on acoustic resonance to produce its sound. When used to support a drum, the drum head itself may be part, even an integral part, of the suspension system. The mounting frame of the invention may serve simply as a framework or structural portion of the invention. As will be demonstrated, the use of drum head as a part of the system may be accomplished in a number of ways. The invention may also lie in a method of supporting acoustic instruments such as drums or other percussion instruments.

The invention aims to correct limitations and deficiencies of instrument mounting systems, particularly previous drum mounting systems. The invention is more integral with the instrument than previous mounting systems.

As previously explained, an improved form of isolation in the frame-to-instrument connection was needed to remedy the limitations of the prior art. The present invention provides a superior way to hold or support an instrument while not limiting or being affected by the angle or positioning of the instrument.

Using materials under certain circumstances that neither absorb, dampen or transfer resonance is found to solve the afore-describe flaws of the prior art. Such provide an ultimate form of isolation. The material used may be a material that when not under tension does not transfer or restrict resonance in any way. It functions as a resonance isolator. When used as a medium to connect an instrument, such as a drum, to its holder, it may totally isolate the vibrating structure or instrument from the mounting system's framework.

The present invention may employ elements of films made of a material such as polyethylene-terephthalate, or acetal, or a similarly strong and flexible material, such as the straps of the exemplary embodiments disclosed herein, that are attached to the instrument, such as to the drum head hoop and the drum shell. These elements may be incorporated integrally into the drum head. The elements may extend between this hoop around the drum to a circular frame or support that extends far enough around the drum to support or balance the weight of the drum, regardless of its angle of tilt.

When used with a drum, the present invention may or may not be attached to the tension rods or any vibrating part of the drum but rather to the least resonant part of the drum. It may be attached somewhere between the tension rods and preferably may have some form of attachment to the drum head hoop. This gives greater flexibility for attachment without being restricted to tension rods around the drum.

These elements may extend from the hoop in some manner so as to connect to a modified frame structure that is simple in design, and may have two or more attachment points. The two or more attachment points may be approximately one hundred and eighty angular degrees apart around the drum (diametrically opposed). The elements may vary in length and width depending on the strength needed to support the drum. By using a nonvibrating material that is not under any significant degree of tension, such as a polyethylene-terephthalate strap extending from the drum hoop, total isolation can be achieved.

Preferably, the support structure includes three attachment points spaced approximately ninety angular degrees apart around the drum. The tuning rods of the drum may pass through holes in these elements, but should preferably avoid contact with them. Resonance is not picked up or transferred through the flexible material of the elements since they are not under sufficient tension to vibrate. Intermittent elements may be disposed between adjacent supporting elements to stabilize the drum and prevent rocking.

The invention may be embodied as an acoustic instrument support system including one or more straps each having an inner end attached to and extending from the instrument to an outer end attached to a support frame surrounding the instrument, where the support frame is spaced and isolated from the instrument except through the one or more straps. The one or more straps may each be made of an acoustically isolating material. The material may be acoustically isolating when not under tension. The material may be taken from the group including polyethylene-terephthalate, acetal, aramid fibers, polyamide, polyoxymethylene, polyester, polypropylene, and polyethylene.

The one or more straps may each have a length, a width, and a thickness, the length measured radially from the instrument, the width measured tangential to the instrument, and the thickness measured perpendicular to the length and the width. The ratio of the width to the thickness may be greater than approximately five to one. The ratio of the length to the thickness may be greater than approximately twenty to one. The ratio of the length to the width may be greater than approximately two to one.

The instrument may have a thin-filmed percussion head, and the one or more straps may each be made of the same material as the percussion head. The instrument may have a thin-filmed percussion head, and the one or more straps may be integral with the percussion head and/or the one or more straps may each be made of the percussion head.

The instrument may be a drum and the percussion head may be a drum head, and the one or more straps may each be an integral extension of the drum head.

The invention may also be embodied as an acoustic instrument support system including a plurality of straps and a circular support ring, the support ring encircling the instrument and spaced radially there-from, and the straps each having an inner end attached to and extending from the instrument to an outer end including a fastener attached to the support ring, where the support ring is isolated from the instrument except through the straps.

The straps may be equally spaced about the instrument. The inner ends may be attached to the instrument on a first plane, and the support ring may disposed on a second plane separated from and substantially parallel to the first plane, where the straps further extend from the inner ends at the first plan to the fasteners attached to the support ring at the second plane.

The support ring may be disposed and configured for connection to a tripod drum stand. The straps may be made of a material taken from the group including polyethylene-terephthalate, acetal, aramid fibers, polyamide, polyoxymethylene, polyester, polypropylene, and polyethylene.

The straps may each have a flexible portion disposed between the attached inner and outer ends and having a length, a width, and a thickness, the length measured from the inner end to the outer end, the width measured tangential to the instrument, and the thickness measured perpendicular to the length and the width, and the ratio of the width to the thickness may be greater than approximately five to one. The ratio of the length to the thickness may be greater than approximately twenty to one. The ratio of the length to the width may be greater than approximately two to one.

The invention may further be embodied as a method for suspending an acoustic instrument from a circular support ring encircling the instrument and spaced radially outwardly there-from, the method including; affixing an inner end of each of a plurality of straps to and substantially equally around the instrument, extending each strap outwardly to the support ring, and fastening an outer end of each strap to the support ring.

Further features and aspects of the invention are disclosed with more specificity in the Detailed Description and Drawings of an exemplary embodiment provided herein.

BRIEF DESCRIPTION OF THE DRAWINGS

Many aspects of the invention can be better understood with reference to the following drawings showing the representative embodiment of the accompanying Detailed Description. The components in the drawings are not necessarily to scale, emphasis instead being placed upon clearly illustrating the principles of the invention. Moreover, in the drawings, like reference numerals designate corresponding parts throughout the several views.

DETAILED DESCRIPTION OF REPRESENTATIVE EMBODIMENTS

Figure 1:
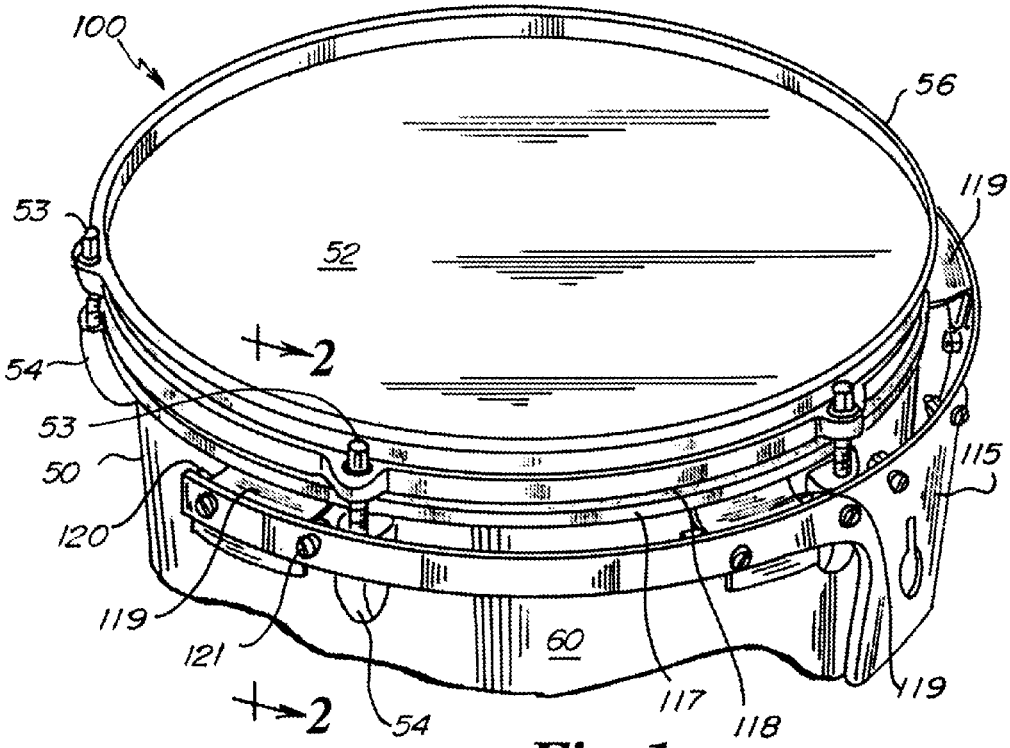
FIG. 1 is a partial perspective view of a typical tom drum and a suspension frame according to a first exemplary embodiment for employing the invention.
Figure 2:
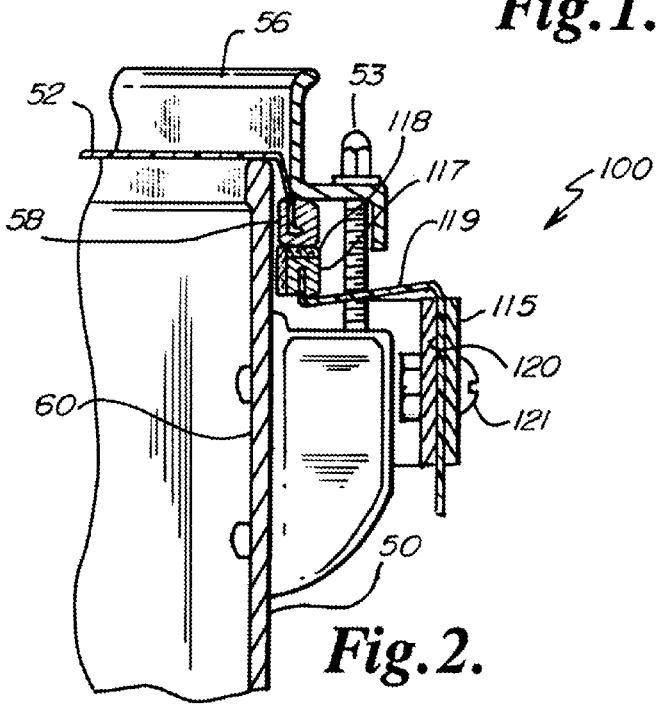
FIG. 2 is a partial cross-sectional view of the drum and suspension frame of FIG. 1.

FIGS. 1 and 2 show a first exemplary embodiment of a support system 100 for a drum 50 which uses a suspension frame to support the drum using flexible straps 119.

Standard tom drum 50 has a drum head including head skin 52 and counter hoop 56 affixed to the lugs 54 of the drum via tension rods 53. Mounting suspension frame 115 would be affixed to a typical mounting stand (not shown). Multiple tension rods 53 surround the shell at equally spaced points and pass through holes in counter hoop 56, threading into the lugs 54 which are fixedly attached to the shell 60 of the drum.

In the embodiment of FIGS. 1 and 2, four straps 119 connect the mounting frame 115 to attachment hoop 117 surrounding and spaced apart from the shell of the drum. The multiple straps are fastened to the suspension frame 115 and fastened in place by any effective attachment means, such as the capture of the straps between backing plate 120 and the frame, which is secured by screws 121 located on either side of the straps. The preferably metallic attachment hoop 117 is disposed underneath and supports the drum head hoop 58 and is laminated with insulator(s) 118 to soften the contact between the two hoops.

The connecting straps 119 are preferably equal in length, which is standardized according to the drum diameter, but may vary in width depending on the weight and diameter of the drum. To prevent the ends of the mounting frame from bending inwardly from a particularly heavy drum's concentration of weight in this area, a wider width of strap material may be used to spread the weight over a larger angle of both the attachment hoop 117 and the mounting frame 115. This may also be accomplished by using either several straps of various widths or using one complete extended strap of material starting at one end of the mounting frame 115 and extending to the other end.

It is of importance that most of the drum's weight is held at the ends of mounting frame 115 since it divides the weight of the drum in half by supporting it at points approximately one-hundred and eighty angular degrees apart around the drum. The use of a flexible material in this area causes the ends of the frame to be pulled inward depending on the weight of the drum. In designing the straps for drums of various dimensions and weights, altering the width of one or more of the flexible straps 119 or using a different number and/or spacing of straps allows the weight of the drum to be distributed properly. For instance, in designing the straps for heavier drums, increasing the width of one or more of the flexible straps or using more straps at a closer spacing allows the weight of the drum to be distributed more evenly and over more area, allowing the frame to dissipate more of the drum's weight over its extended length rather than just a small section at the very ends. An alternate approach uses a thicker film for the strap material for heavier drums and thinner film for lighter drums.

Drum 50 is approximately thirteen inches in diameter and nine inches tall. Its weight is approximately eight pounds. Its shell is approximately three-sixteenths of an inch thick. Three straps two inches wide by ten thousandths of an inch thick are spaced equally apart along the frame. This is found to be sufficient to prevent the ends of an aluminum mounting frame from bending inwardly. An alternate approach employs a steel frame that may require fewer straps.

Figure 3:
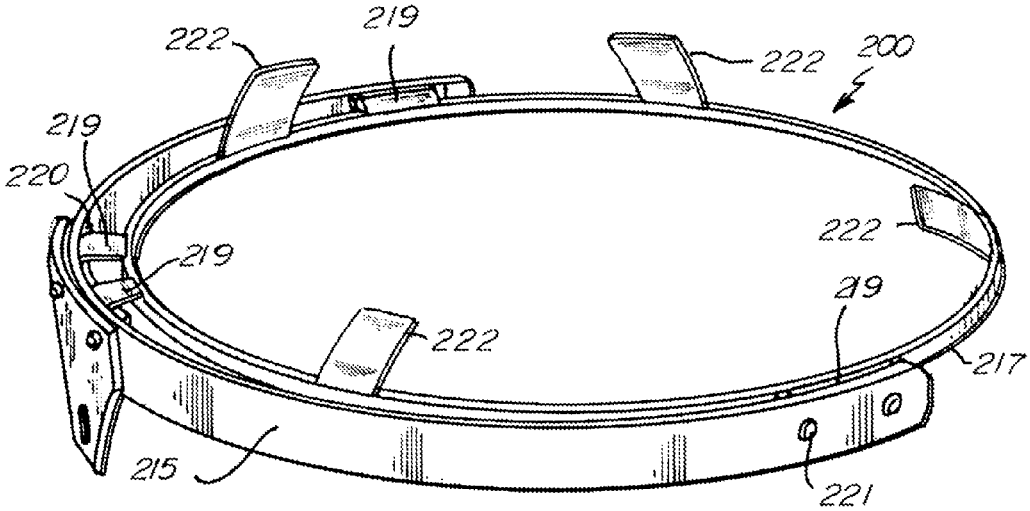
FIG. 3 is a perspective view of a suspension frame according to a second exemplary embodiment for employing the invention.

FIG. 3 shows the support portion 200 of a mounting system according to a second embodiment for employing the invention having a mounting frame 215 and attachment hoop 217 with both outer straps 219 and inner straps 222. Such a system may be used in various mounting configurations, such as those demonstrated by the mounting system 300 of FIG. 4 and mounting system 400 of FIG. 5. An advantage of the systems of FIGS. 4 and 5 over that of FIG. 1 is that the mounting system of these later embodiments is more securely attached to the drum via the inner straps, as will be explained.

Referring to FIG. 3, mounting frame 215 extends approximately one hundred and eighty angular degrees and is slightly larger than the attachment hoop 217, which in turn is slightly larger than a drum's shell diameter. The mounting frame is connected to the attachment hoop 217 by a plurality of outer straps 219 extending between the frame and attachment hoop, as in the first embodiment. As in the first embodiment, attachment hoop 217 is the same size and almost identical to a drum head hoop. Inner straps 222 are spaced about and directed inwardly from the attachment hoop. The inner and outer straps may be glued or crimped into the attachment hoop in any of the same ways that a head skin is typically attached to a head hoop.

Figure 4:
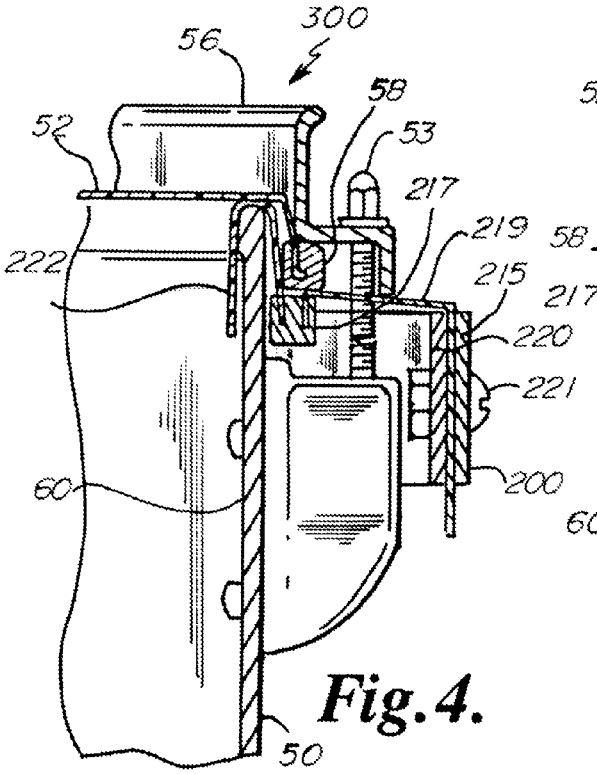
FIG. 4 is a partial cross-sectional view of the drum of FIG. 1 and a suspension frame according to a third exemplary embodiment for employing the invention.

Referring to FIG. 4, there is shown the drum 50 within a third exemplary embodiment for employing the invention 300, which is a first arrangement for the use of the support portion 200 of FIG. 3. Attachment hoop 217 is disposed under the drum's head hoop 58, as in the invention's first embodiment. It may have some flexible fingers (not shown) aiming inwardly towards the drum to keep the attachment hoop centered around the drum shell 60 and to isolate the attachment hoop from the shell and prevent firm contact, which could cause adverse acoustical effects.

Inner straps 222 extend inwardly under the drum head hoop 58 and the drum head skin 52 and between the skin and the bearing edge of the drum shell 60 before the drum head is affixed to the shell, and the inner straps become trapped between the head skin and the shell when the drum head is attached to the drum. Tightening the tension rods 53 tightens the drum head to the shell, thereby capturing the inner straps 222 and affixing the support 200 to the drum 50.

Figure 5:
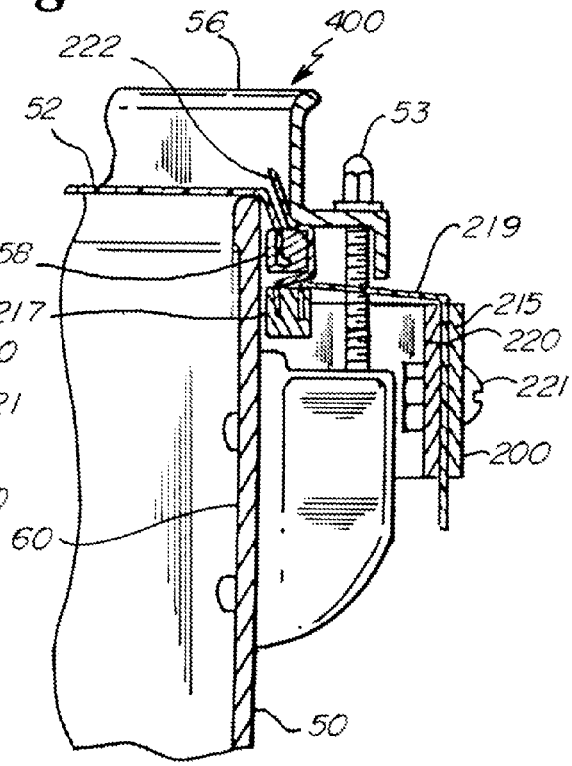
FIG. 5 is a partial cross-sectional view of the drum of FIG. 1 and a suspension frame according to a fourth exemplary embodiment for employing the invention.

The attachment arrangement of FIG. 5 eliminates the need for the insulator(s) of the first embodiment because the outer straps are disposed between the two hoops to provide the function of the insulator(s) so that the two metallic hoops do not make hard contact, which may create undesirable acoustical effects.

Referring to FIG. 5, there is shown the drum 50 within a fourth exemplary embodiment for employing the invention 400, which is a second arrangement for the use of the support portion 200 of FIG. 3. Attachment hoop 217 is disposed under the drum's head hoop 58, as in the invention's first embodiment. It may additionally have some flexible fingers (not shown) aiming inwardly towards the drum to keep the attachment hoop centered around the drum shell 60 and to isolate the attachment hoop from the shell and prevent firm contact, which could cause adverse acoustical effects.

In this embodiment, inner straps 222 extend inwardly over the drum head hoop 58 and between the head hoop and the drum's counter hoop 56, before the counter hoop is affixed to the shell, and the inner straps become trapped between the counter hoop and the head hoop when the counter hoop is attached to the drum. Tightening the tension rods 53 pulls the counter hoop 56 down and tightens the drum head to the shell, thereby capturing the inner straps 222 and affixing the support 200 to the drum 50.

The attachment arrangement of FIG. 5 is found to provide superior resonance isolation between the attachment and head hoops, in part because the inner straps are disposed between the two hoops to take the place of the insulator(s) of the first embodiment, and to suspend the head hoop above and spaced apart from the attachment hoop so the two metallic hoops do not make contact, which may create undesirable acoustical effects.

The points of attachment of the inner straps to the drum in both FIGS. 4 and 5 are areas of non-vibration, which make them excellent attachment points since the vibrating structure is not affected in any way by suspension frame or the angle at which the drum is positioned. Changing the drum's center of gravity is no longer a factor in affecting the resonance.

Figure 6:
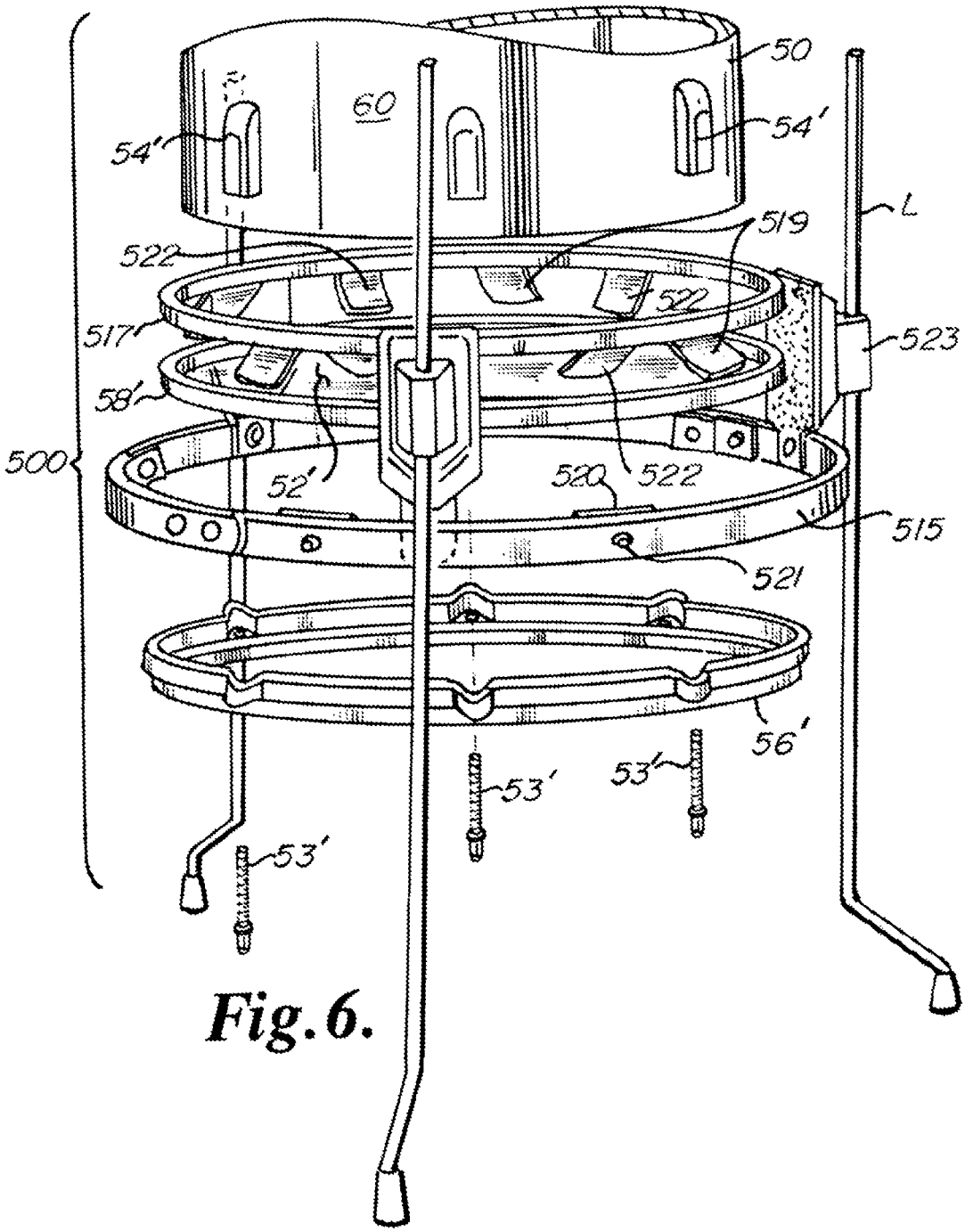
FIG. 6 is an exploded perspective view of the drum of FIG. 1 and a suspension frame according to a fifth exemplary embodiment for employing the invention.
Figure 7:
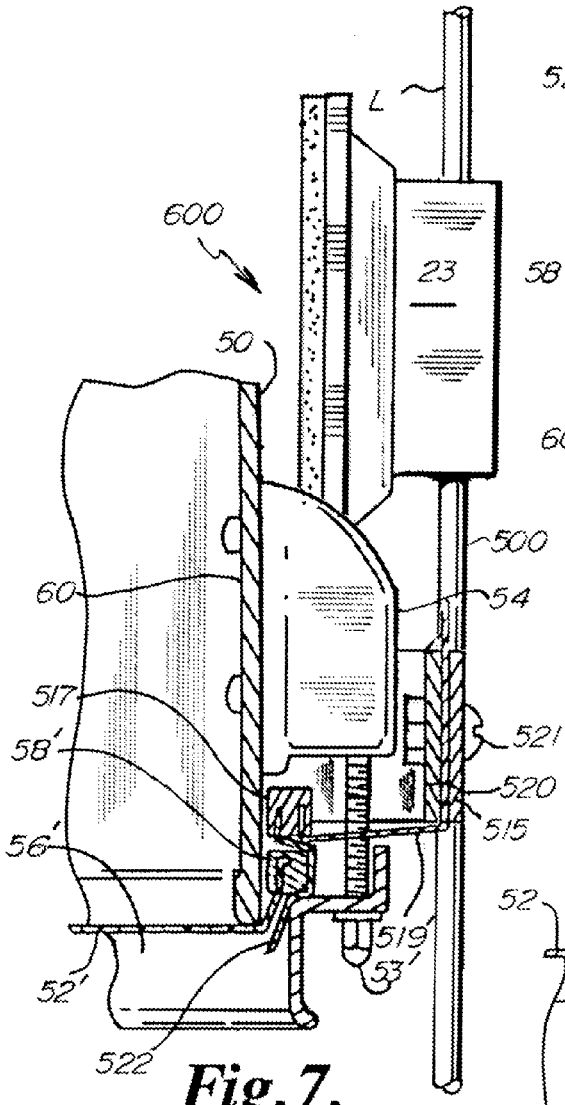
FIG. 7 is a partial cross-sectional view of the drum of FIG. 1 and a suspension frame according to a sixth exemplary embodiment for employing the invention.

FIG. 6 illustrates a mounting system 500 which is an adaptation of either of the mounting arrangements of FIG. 4 or 5 to a bottom-mounted support system. Inner straps 522 may be captured between the lower bearing edge of the shell 60 of drum 50 and the drum's lower head ring 58' in an upside-down version of the arrangement of FIG. 4. Or else, as shown in FIG. 7, the inner straps 522 may be captured between the lower counter hoop 56' and the lower head hoop 58' a sixth embodiment for employing the inventions that is essentially an upside down version of the arrangement of FIG. 5. Legs L are attached to a holder 523 which is fastened to the support frame 515.

Support frame 515 preferably extends a full three hundred and sixty degrees around the drum 50 and is affixed to three legs L, spaced equally apart around the drum to stably support the weight of the drum.

Figure 8:
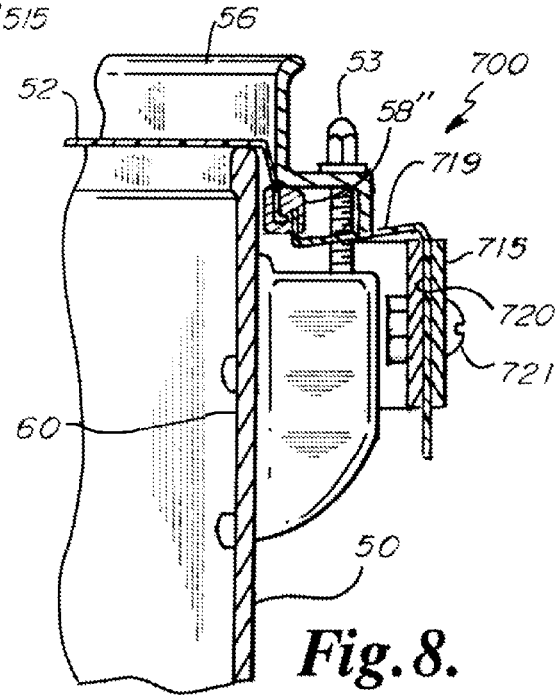
FIG. 8 is a partial cross-sectional view of the drum of FIG. 1 and a suspension frame according to a seventh exemplary embodiment for employing the invention.

FIG. 8 depicts a seventh embodiment for employing the invention which is a mounting system 700 similar to the system of FIG. 2 except that the support system's attachment hoop has been integrated into the drum head hoop 58", thereby eliminating the redundancy of the two hoops and insulation and affixation requirements associated therewith. The material of the drum head skin 52 material may alternatively extend from the head hoop to form the straps 719 that extend to the suspension frame 715.

Figure 9:
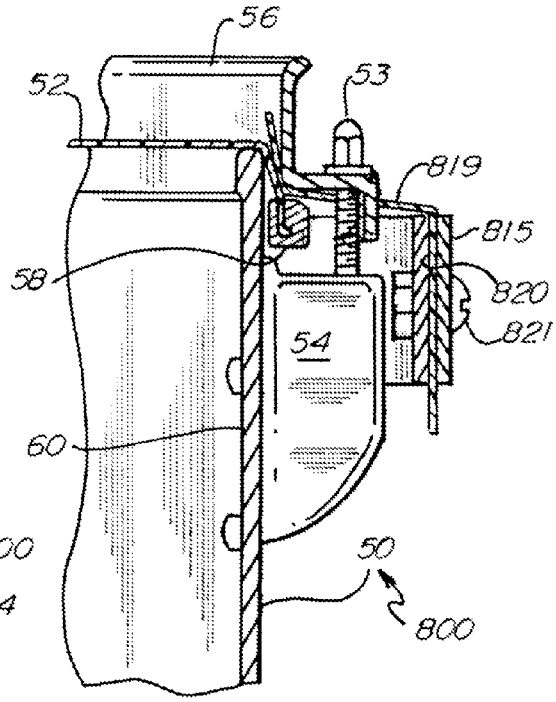
FIG. 9 is a partial cross-sectional view of the drum of FIG. 1 and a suspension frame according to an eighth exemplary embodiment for employing the invention.

FIG. 9 depicts an eighth embodiment for employing the invention which is a mounting system 800 that somewhat hybridizes the embodiments of FIGS. 5 and 8. The attachment hoop is eliminated from FIG. 8, and inner straps of FIG. 5 are eliminated. Straps 819 serve the function of both the inner straps and outer straps and connect the support frame 815 directly to drum 50 by an arrangement similar to that of FIG. 5, wherein straps 819 are captured between counter hoop 56 and the drum head as the counter ring is fastened to the drum. Tightening of the tuning rods 53 into lugs 54 secures the straps firmly in place. Again, the width, positioning, and number of straps may be altered according to the diameter and weight of the drum 50.

Figure 10:
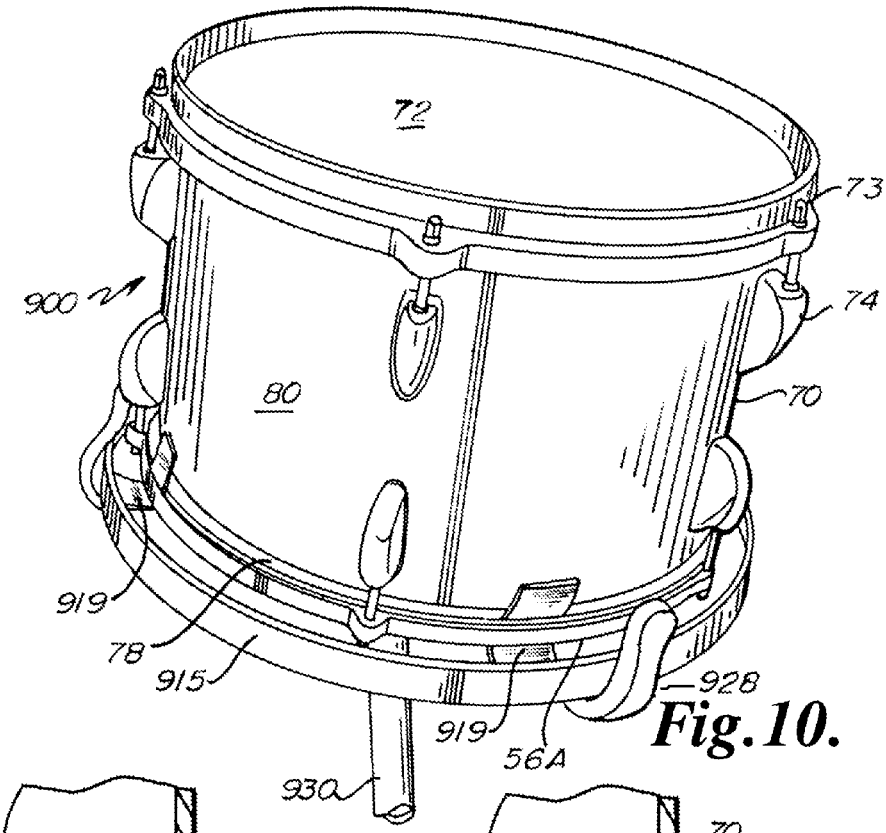
FIG. 10 is a perspective view of a second tom drum and a suspension frame according to a ninth exemplary embodiment for employing the invention.
Figure 11:
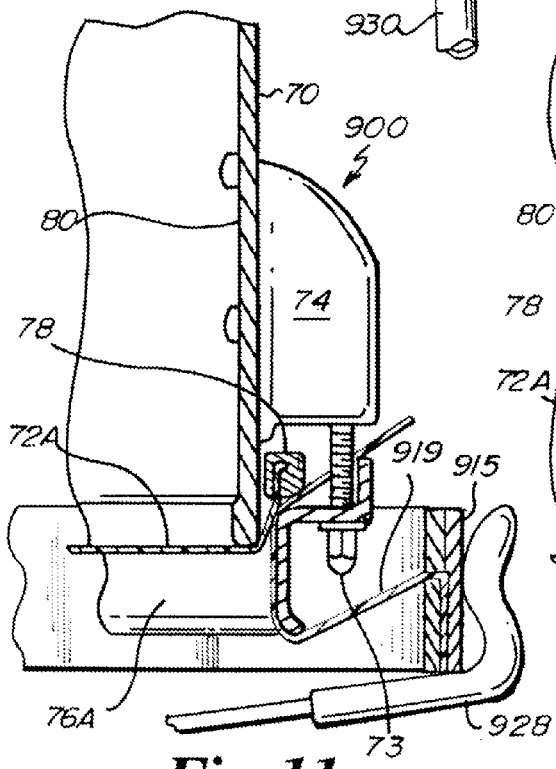
FIG. 11 is a partial cross-sectional view of the drum and suspension frame of FIG. 10.
Figure 12:
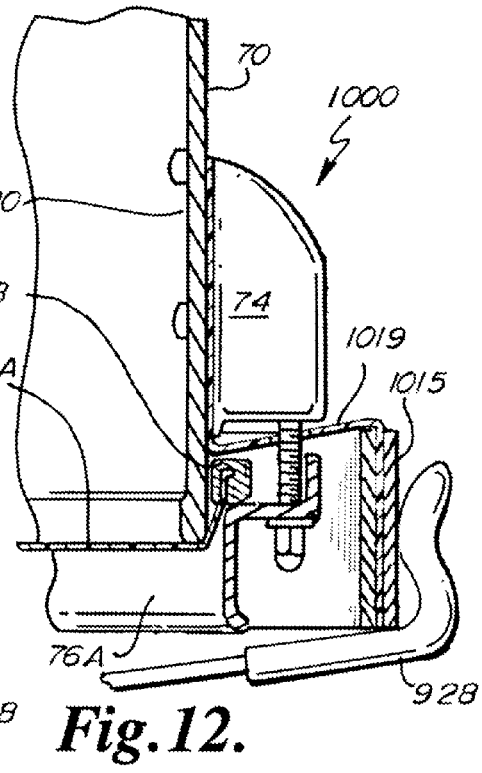
FIG. 12 is a partial cross-sectional view of the drum and suspension frame of FIG. 10 and a suspension frame according to a tenth exemplary embodiment for employing the invention.

FIGS. 10, 11 & 12 illustrate the use of the invention in conjunction with a Remo Corporation drum 70 as demonstrated in U.S. Pat. No. 4,416,181.

In FIGS. 10 and 11, mounting structure 900 includes support frame 915, which rests in stand arms 928. Straps 919 extend inwardly from the support frame and are captured between the lower counter hoop 76A and the lower head hoop 78. Tightening of the tuning rods 73 into lugs 74 secures the straps firmly in place. Again, the width, positioning, and number of straps may be altered according to the diameter and weight of the drum 70.

The primary difference between this embodiment and that of FIG. 6 lies in the means of support of the suspension frame. The embodiment of FIG. 6 shows the use of a three-legged stand with holders 523 attached to the support frame 515. The embodiment of FIG. 10 shows frame 915 supported by a tripod style stand 930.

Normally, such a tripod stand would make hard contact with the bottom counter hoop 76A with three arms 928 extending from the stand column. The arms are normally adjusted inwardly to create a clamping pressure against the counter hoop to secure the drum. Such firm contact restricts the drum from resonating, thereby choking the sound that is normally produced when the drum is played. By using the support frame 915 to make contact with the arms, isolation of the resonating drum is achieved. No direct contact is made between the stand and any part of the drum.

FIG. 12 illustrates another support structure 1000 providing another form of strap attachment, by extending straps 1019 inwardly from support frame 1015 and underneath the drum's lugs 74, which are fastened firmly to shell 80. The number of straps may be altered according to the drum's weight and diameter.

It should be appreciated that the mounting supports used in the embodiments of FIGS. 1 through 5, which extend approximately one-hundred and eighty degrees around the drum, may be configured to support the drums at their tops or bottoms, while the mounting supports shown in the embodiments of FIGS. 6 through 12, which extend fully around the drum, are preferable for supporting larger floor tom drums at their bottoms.

FIGS. 13 through 18 depict embodiments for employing the invention to support a drum from below on a stand by using inwardly extending straps, preferably made of the same material used in the drum head, and a circular hoop, preferably of aluminum, to hold the straps and isolate the drum from the stand. It should be noted that the straps may be cut from the same sheet of film as is used for the head. For instance, in the case where a twelve-inch diameter piece of film is needed for the drum head, a fifteen-inch or so diameter of film may initially be used with the twelve-inch diameter head punched from its center and the remaining periphery used to make the straps.

Figure 13:
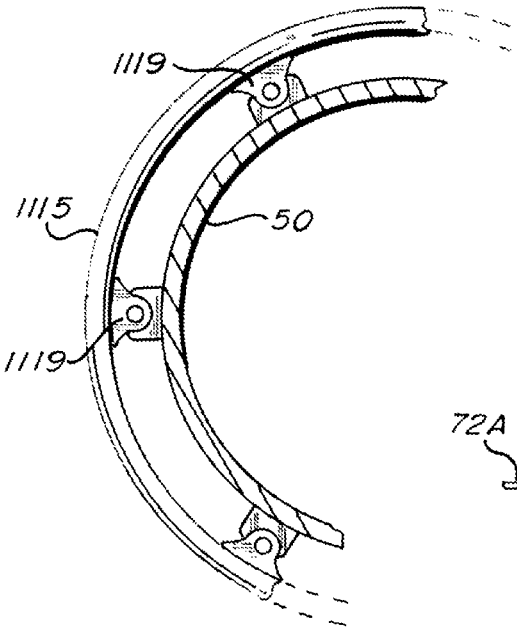
FIG. 13 is a partial top sectional view of the drum of FIG. 1 and a suspension frame according to an eleventh exemplary embodiment for employing the invention.
Figure 14:
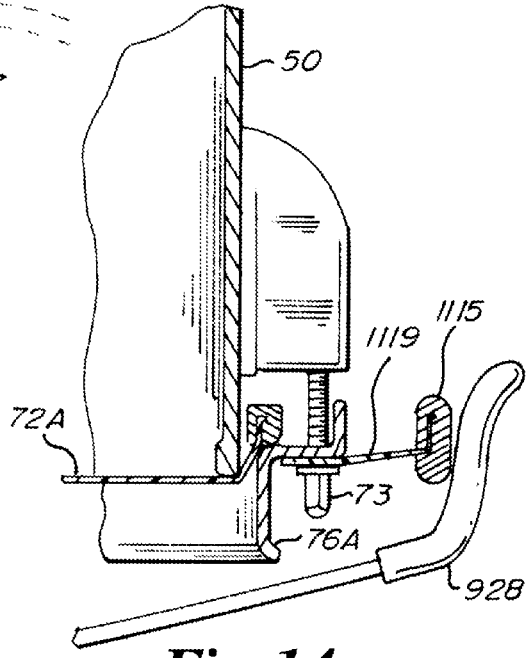
FIG. 14 is a partial cross-sectional view of the drum and suspension frame of FIG. 13.

While the drum head shown in FIGS. 13 through 18 may be either a PTS or a standard head, it is preferable that the embodiment of FIGS. 13 and 14 be used with a PTS head while the embodiments of FIGS. 15 through 18 are preferably used with a standard head.

For clarification; a PTS (pre-tuned system) head is a proprietary product manufactured by the Remo Corporation and a standard drum head is the more typical non-proprietary type used by most other manufacturers. The PTS system is described in U.S. Pat. Nos. 4,356,756, 4,416,181, and 4,549,462, the specifications of which are incorporated herein in their entireties by reference. The PTS head is pre-tensioned as the drum head is manufactured, while tensioning of the standard head is achieved at drum assembly by adjustment of the tuning rods. The preferably Polyethylene-terephthalate film is stretched to create a tension or pitch to the PTS head during manufacture of the head itself.

Standard drum heads have a film that is glued or clamped within the hoop without any stretching or tensioning. Unlike the PTS head, the standard drum head is not tensioned or tuned until it is placed on the drum and the tuning rods 73 are adjusted.

While some of the more advanced PTS heads provide some form of integrated tuning capability, the basic PTS head makes no allowance within the head itself for tuning or adjusting. Tightening of the tuning rods is used during assembly of the drum to create the tension or pitch to the standard head's film.

Referring to FIGS. 13 and 14, an eleventh embodiment for using the invention with a PTS head is depicted in which straps 1119 are affixed to support hoop 1115, preferably by glue or clamping. The support hoop rests on or is captured by a typical stand 928, with the straps thereby providing acoustic isolation between the drum 50 and the stand. In FIG. 14 it can be seen that the straps 1119 extend inwardly from hoop 1115 approximate the vertical mid-point of the hoop's inner surface and perpendicular thereto. The straps extend to the drum's lower counter-hoop 76A, where they are affixed thereto with holes aligned with the holes of the counter-hoop for attachment to the tuning rods 73. The straps may be formed of a web or may be individual and separate components. In the case where they are formed of a web, that web may be the aforementioned remaining periphery of a larger diameter piece of film from which the drum head was punched. In the case where the straps are individual and separate components, the straps may be cut from the corners of a square piece of film from which the round drum head was punched, which corners would otherwise have been left-over material. A similar and vertically flipped arrangement could alternatively support a tom drum at its upper counter hoop.

The straps may alternatively be manufactured of a completely different piece of film from the drum head, such as in cases where straps of a different material or thickness is desired for optimal acoustic isolation.

Figure 15:
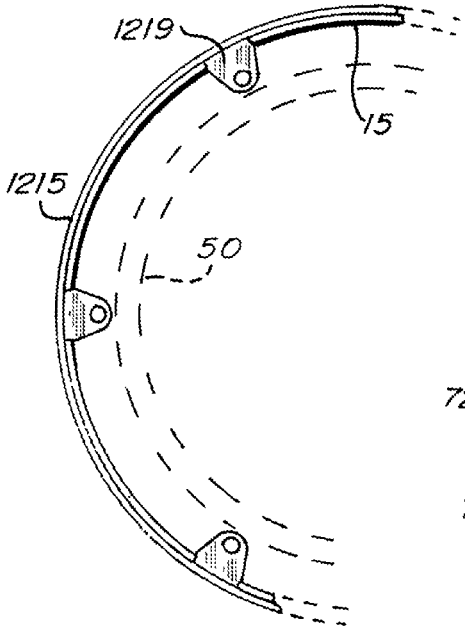
FIG. 15 is a partial top sectional view of the drum of FIG. 1 and a suspension frame according to a twelfth exemplary embodiment for employing the invention.
Figure 16:
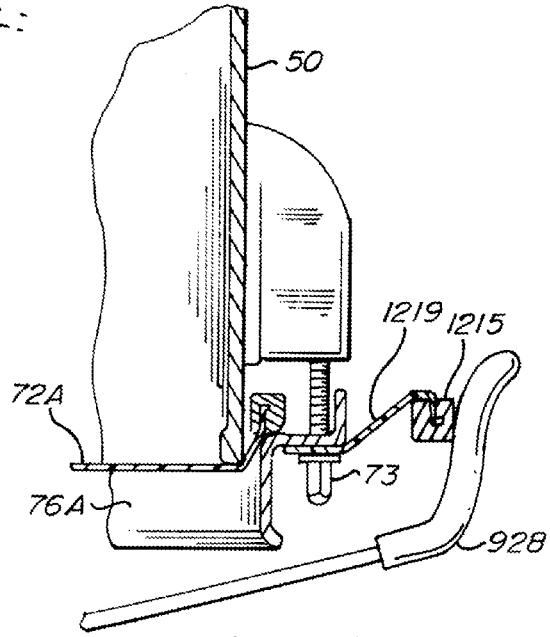
FIG. 16 is a partial cross-sectional view of the drum and suspension frame of FIG. 15.

FIGS. 15 and 16 depict a twelfth embodiment for using the invention using non-tensioned straps 1219, affixed to support hoop 1215, preferably by glue or clamping. The support hoop rests on or is captured by a typical stand 928, with the straps thereby providing acoustic isolation between the drum 50 and the stand. In FIG. 16 it can be seen that the straps 1219 extend upwardly from hoop 1215 approximate the horizontal mid-point of the hoop's top surface thereto. The straps extend inwardly to lower counter-hoop 76A, where they are affixed thereto by the tuning rods 73. As in the previous embodiment, the straps may be formed of a web or may be individual and separate components. A similar and vertically flipped arrangement could alternatively support a tom drum at its upper counter hoop.

Figure 17:
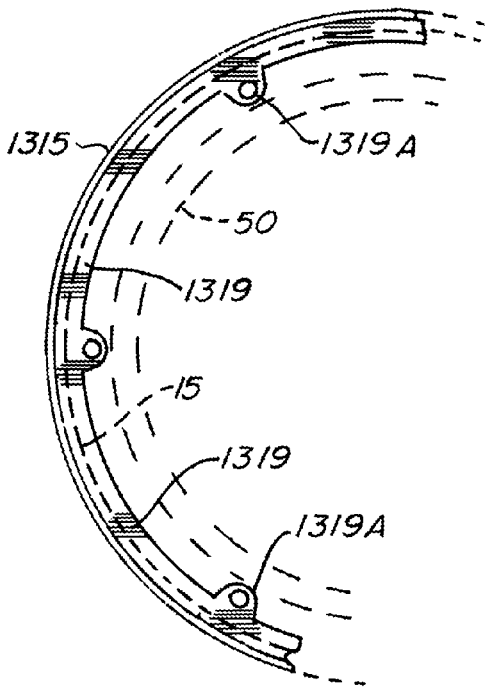
FIG. 17 is a partial top sectional view of the drum of FIG. 1 and a suspension frame according to a thirteenth exemplary embodiment for employing the invention.
Figure 18:
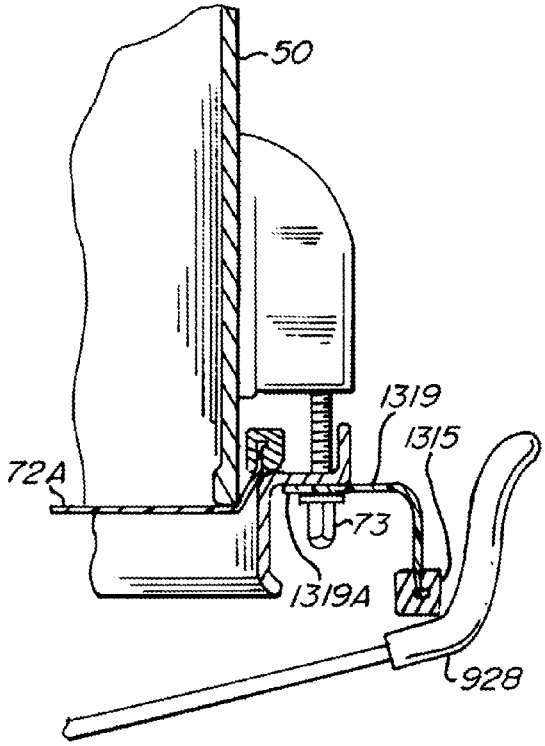
FIG. 18 is a partial cross-sectional view of the drum and suspension frame of FIG. 17.

FIGS. 17 and 18 depict a thirteenth embodiment for using the invention using non-tensioned straps 1319A connected by circular web 1319 which is affixed to support hoop 1315, preferably by glue or clamping. As in the previous embodiments, the support hoop rests on or is captured by a typical stand 928, with the straps thereby providing acoustic isolation between the drum 50 and the stand. In FIG. 18 it can be seen that the web 1319 extends upwardly from hoop 1315 approximate the horizontal mid-point of the hoop's top surface and perpendicular thereto. The web forms a radius as it extends inwardly towards the drum. The straps 1319A extend inwardly from the web to lower counter-hoop 76A, where they are affixed thereto by the tuning rods 73. As shown, the straps and web are integrally formed and may be taken from the aforementioned remaining periphery of a larger diameter piece of film from which the drum head was punched. A similar and vertically flipped arrangement could alternatively support a tom drum at its upper counter hoop.

When the invention is used with a PTS head system, as shown in FIGS. 13 and 14, straps 1119 may preferably also be pre-tensioned for acoustical optimization with the head which, as seen in FIG. 14, prevents sagging or drooping of the straps due to the tension already built into them. It can be seen that straps 1219 of FIGS. 15 and 16 may have some drooping or sagging, which may be controlled by material selection or thickness of the straps for sufficient support and acoustical performance. It can also be seen that circular web 1319 and straps 1319A of FIGS. 17 and 18 may have some drooping or sagging, which may also be controlled by material selection or thickness of the web and straps.

As shown in FIGS. 13 and 14, the support system's pre-tensioned straps 1119 may be constructed using left-over material from the PTS head film. As shown in FIGS. 15 and 16, the support system's straps 1219 may be constructed using left-over material from the standard head film. As shown in FIGS. 17 and 18, the support system's straps 1319 may be constructed using otherwise left-over material from the standard head film.

As shown in the embodiments of FIGS. 13 to 18, the straps suspend and isolate the drum from a stand such as a standard three-arm tripod snare drum. Such stands, when used in the traditional configuration of supporting the drum by clamping the drum's counter hoop, would normally choke the resonance of the drum by creating pressure on the drum's shell. The various strap configurations also provide shock absorption to protect the drums from damage by permitting flexing between the drum and its stand.

The support hoop provides a sufficiently strong structure that contacts the three tripod arms and provides a simple form of isolation through the flexible straps. This allows the drum to resonate to its fullest potential, free from choking by the stand. The straps, preferably made of a film such as polyethylene-terephthalate, may be attached in between the tuning rods and the counter hoop in a manner which may make use of standard drum assembly procedures and configurations.

Figure 19:
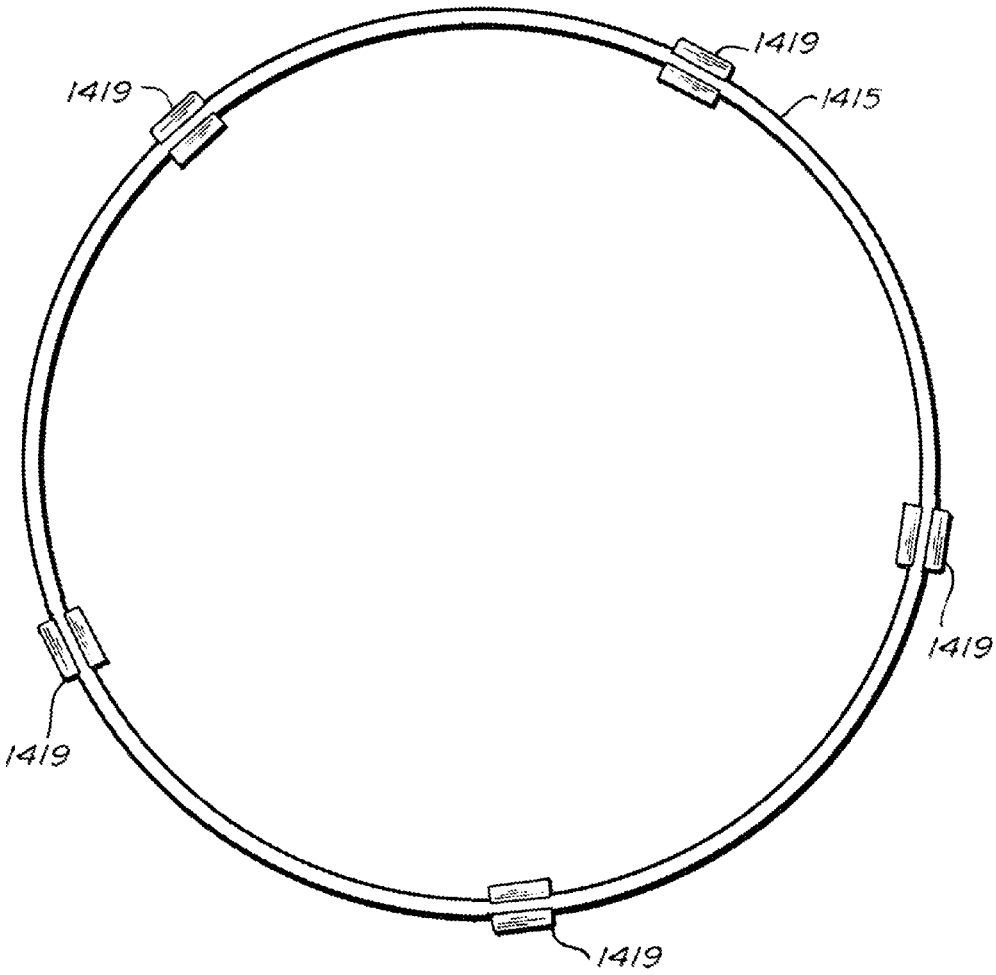
FIG. 19 is a bottom view of a suspension system in accordance with a fourteenth embodiment of the invention.
Figure 21:
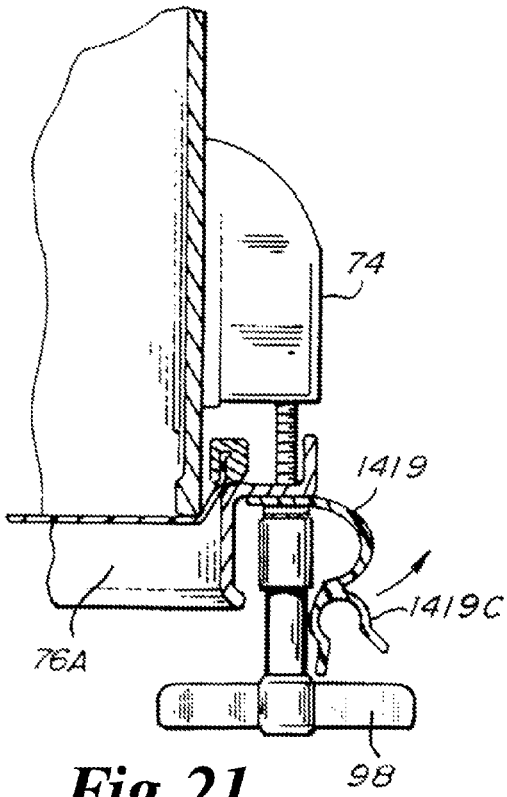
FIG. 21 is a partial cross-sectional view of the drum and the suspension system of FIG. 20 with the frame removed.
Figure 20:
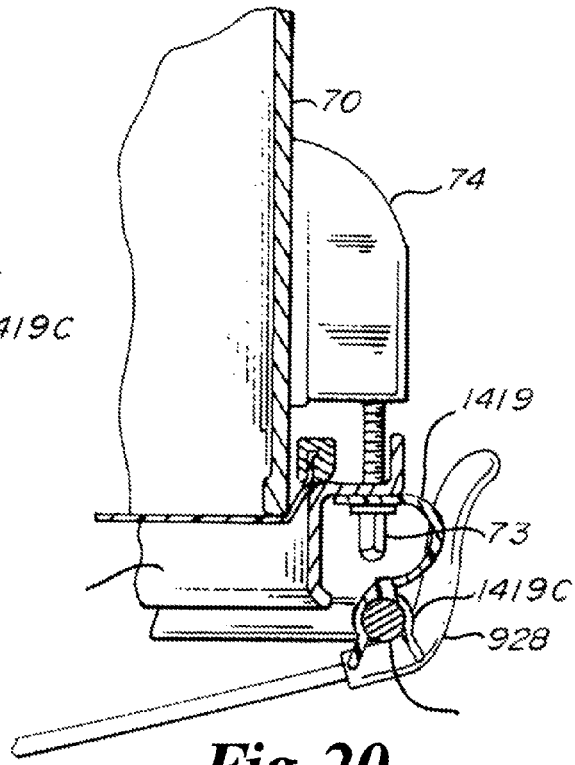
FIG. 20 is a partial cross-sectional view of a drum and the suspension system of FIG. 19.
Figure 22:
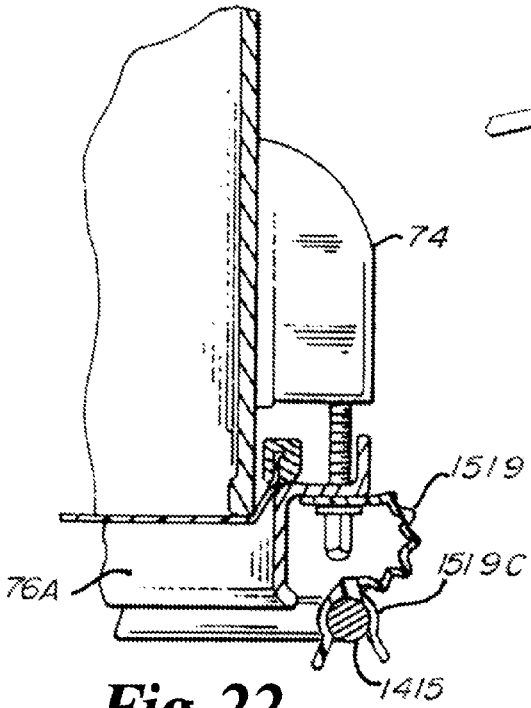
FIG. 22 is a partial cross-sectional view of a drum and suspension system in accordance with a fifteenth embodiment of the invention.

The fourteenth embodiment of FIGS. 19 and 20 and the fifteenth embodiment of FIG. 22 illustrate additional arrangements for practicing the invention. While the afore-described embodiments of FIGS. 1 to 18 would preferably employ components and materials from the pre-existing manufacture of synthetic drum heads, the embodiments of FIGS. 19 through 22 are more adaptable to the use of independently produced components to provide the same suspension function, with some added advantages.

Although the modification of a standard drum head film for use as both a drum head and a suspension support, as demonstrated by the embodiments of FIG. 1 through 18, may be the simplest and most expedient method to practice the invention in some regards, the desire to minimize the size of the drum head film may limit the use thereof in some instances.

As previously mentioned, drum heads are universally available in diameters to fit the standard diameters of most drums from any source; a twelve-inch diameter drum head will fit any twelve-inch drum made by any drum company that uses standard twelve-inch drum shell design, a fourteen-inch diameter drum head will fit any fourteen-inch drum made by any drum company that uses the standard fourteen-inch drum shell design, etc. And drum heads are typically only produced in whole numbers such as eight inches, ten inches, and twelve inches.

For the embodiments of FIGS. 1 through 18 to be used with such standard drum sizes in an arrangement where the support elements are integral extensions of the drum head, the diameters of the head films used to make the suspension supports would preferably be approximately two inches or so larger than the drum being suspended; a twelve-inch drum would require the use of a support made of a fourteen-inch diameter piece of film, a fourteen-inch drum would require the use of a support made of a sixteen-inch diameter piece of film, etc.

While having advantages in many situations, such as a reduction in inventorying components and a reduction in the number of manufacturing steps, this potential limitation of the FIGS. 1 to 18 embodiments gives advantage in some situations to the alternative embodiments of FIGS. 19 through 23B, which use independently manufactured components to form the support straps rather than extensions of the drum head film.

Referring to FIGS. 19 and 20, there is shown a suspension frame in the form of a hoop 1415 having equally-spaced there-around a number of suspension elements 1419. Five elements are shown, intended to correspond to a drum 70 having five lugs 74. However, the actual number of elements 1419 would preferably vary according to the drum size in use and the actual number of lugs used thereon.

As seen best in FIG. 20, the elements are preferably molded of a tough and resilient strap of material such as polyamide, acetal, polyester, or polyethylene-terephthalate, and each have integrally molded therewith a clip 1419 for grasping hoop 1415. The clip is preferably C-shaped and resiliently expandable to snap over the hoop during assembly, and to be removable there-from without yielding. At the other end of each element 1419 is a hole (not shown) which is aligned with the tuning rod 73 so that the element may be affixed to lug 74 via the tuning rod. The hoop 1415 may then be rested upon the arms 928 of a stand to support the drum there-upon.

The thickness and width of the elements may be altered according to the desired acoustical effects desired, with consideration given to the weight of the drum being supported, the number of elements supporting it, and the material used to mold the elements. For a twelve-inch drum having six lugs, it is found that six elements molded of acetal and having a thickness of 0.040" to 0.055" and a width of one inch provide reasonable support and acoustical isolation.

And of course, other means could be used to produce the elements besides the preferred molding, and other clip designs could be substituted . . . or the elements could even be permanently affixed to the hoop 1415 by adhesive or fasteners.

The circular suspension frame may be composed of any of a variety of suitable materials such as plastic, metal, or wood, and need not be restricted to the circular cross-section depicted, but may instead have any suitable cross-sectional shape, such as the rectangular cross-sectional shape of support frame 915 of the ninth embodiment, and the clip or fastening means would then be arranged accordingly. In fact, non-round cross-sections are found to provide some advantages in supporting heavier drums in that the clips are prevented from rotating as they may do around the round cross-sectioned frame. Non-round frame cross-sections such as square, diamond, hexagonal, triangular, and such, when grasped by a clip having a mating contour, provide a more-rotation-proof attachment to the frame.

The circular frame 1415 is only slightly larger than the drum it is to be used with. This allows the support system for a particular sized drum to still be used with a stand designed for that size drum without need to increase the size of the stand. And in particular, this allows a fourteen inch drum to be used with this support system in a standard tri-pod stand.

When the embodiment of FIGS. 19 and 20 is in use on a tri-pod stand as shown in FIG. 20, a strong stable support is provided that isolates and suspends the drum, preventing the direct clamping action normally created on the drum's shell by the three arms of the stand, and eliminating the adverse acoustical dampening such clamping causes. The clamping forces of the arms of the stand now act only on the support frame 1415, and are isolated from the drum itself through elements 1419. This insures that no force or pressure is in direct contact with the shell of the drum at any time, leaving the drum free to resonate fully when it is played.

FIG. 21 shows the embodiment of FIGS. 19 and 20 during tightening of the tuning rods, where the flexible support elements 1419 may be unclipped from the hoop and flexed outwardly to leave room for a drum key 98 to access the tuning rod.

FIG. 22 illustrates a fifteenth embodiment for practicing the invention, identical to the previous embodiment except that the strap portion of the suspension elements 1519 has a corrugated shape, which allows for greater pliancy when bending, and effectively lengthens the strap portion within the same overall element length, for increasing isolation. Lengthening the strap by adding such corrugations creates more separation between the vibrating drum and the circular frame support without requiring a larger support frame 1415.

Figure 23A:
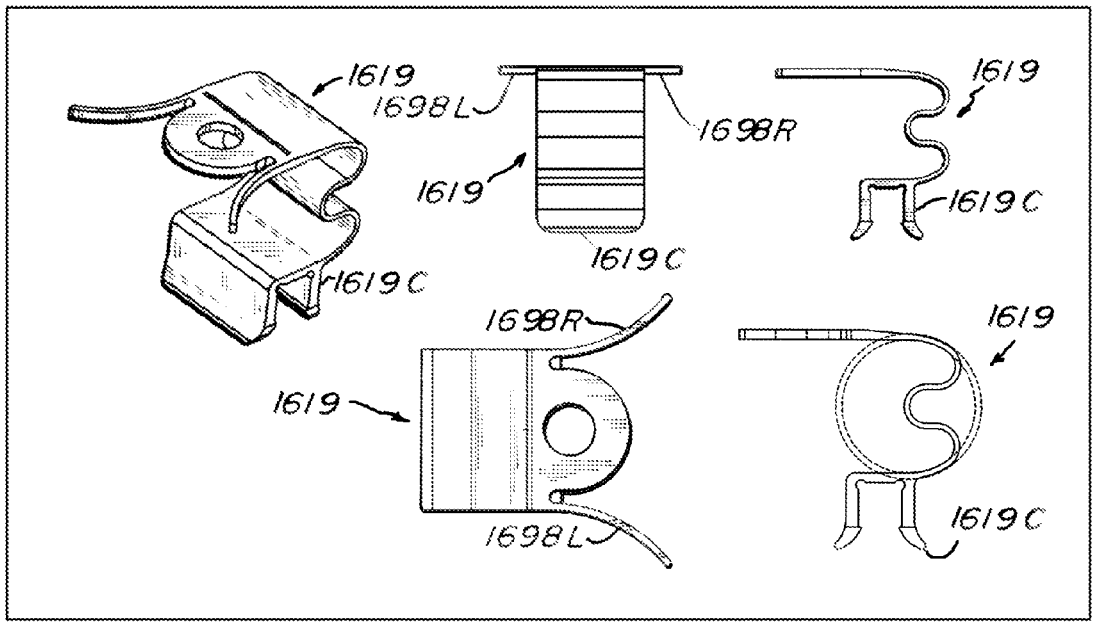
FIG. 23A is a multi-view scale drawing of a molded strap having an integral clip in accordance with a sixteenth embodiment of the invention.
Figure 23B:
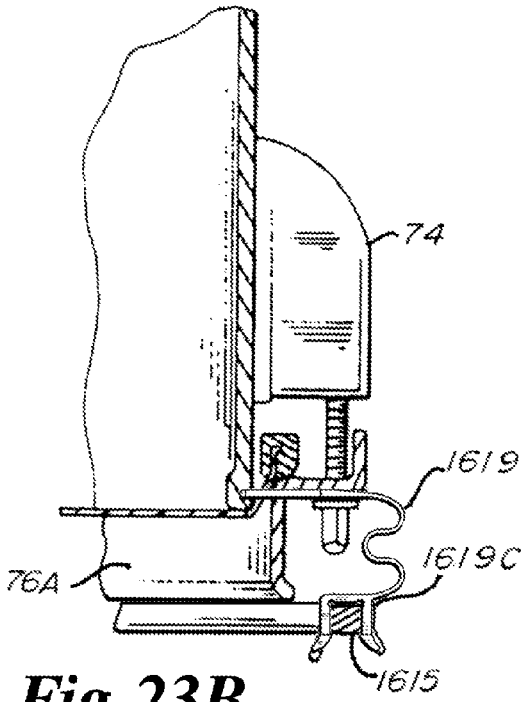
FIG. 23B is a partial cross-sectional view of a drum and suspension system using the strap of FIG. 23A.

FIGS. 23A and 23B illustrate a sixteenth embodiment in the form of a molded strap having an integrally molded clip.

A scale drawing of the strap is shown in FIG. 23A and that strap 1619 is shown in FIG. 23B attached to drum 74 and square cross-sectioned support frame 1615, which grasped by the strap's integrally molded clip 1619C. The strap is affixed to lower counter hoop 76A in the same manner as the previous embodiments.

The outwardly flaring arcuate wings 1698R and 1698L prevent the straps from turning or rotating when attached to the drum's tension rods. As the tension rods are turned, before attaching the support frame to the clips, the straps want to rotate but need to be aligned to the frame before it is attached. The wings create a light pressure against the drum's counter hoop keeping them in alignment and prevent turning.

Figure 23C:
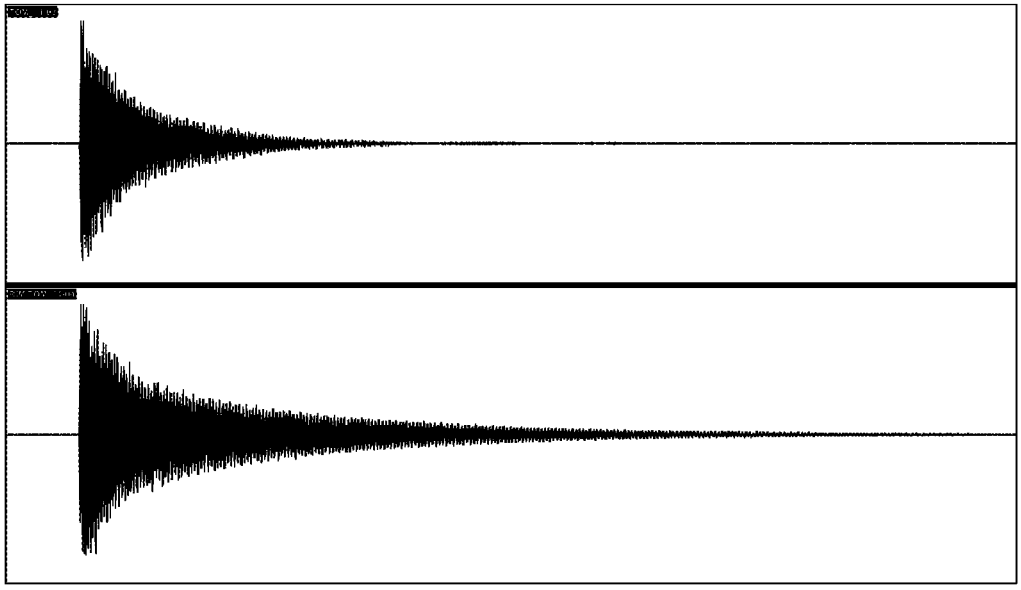
FIG. 23C is a pair of graphs showing the acoustic volume decay waveform over time for a prior art drum and for that drum using the suspension system of FIG. 23B.
Figure 24:
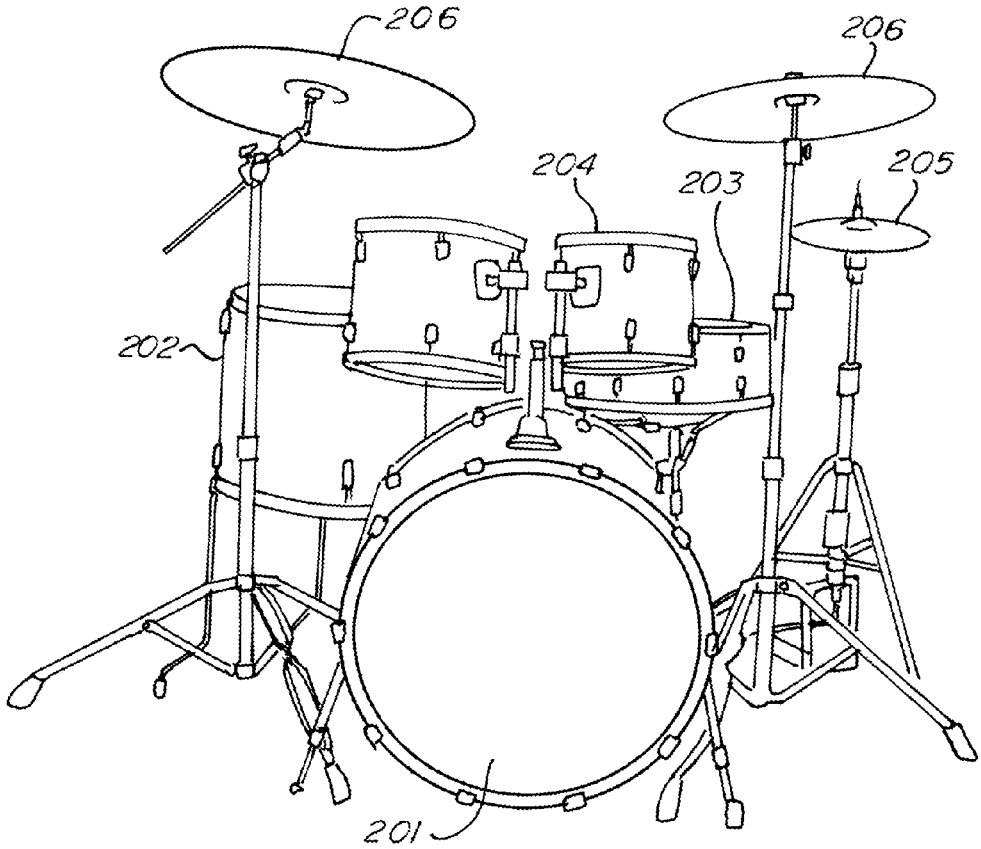
Fig. 24 (PRIOR ART)
FIG. 24 is a front view of a typical prior art drum kit.

The acoustic volume dampening versus time graphs of FIG. 23C illustrate just how effective a support system according to the invention is at avoiding the unwanted acoustical dampening caused by ordinary supports. First, a twelve-inch drum was held in a common tri-pod stand, struck by a mechanically-controlled drum stick, and the volume of the noise produced from the drum was measured and plotted using a Pro Tools Recording System. The volume decay waveform over time is depicted in the uppermost of the two graphs.

Next, the same drum was supported by six of the straps of FIG. 23A, molded of acetal, in the arrangement of FIG. 23B. The drum was then struck identically by the same mechanically-controlled drum stick, and the volume of the noise produced was measured and plotted using the same system and the same settings. The volume decay waveform over time for this arrangement is depicted in the lowermost of the two graphs.

Shown in the graphs by the vertical "fatness" of the image is the amplitude (loudness) of the noise from the drum in both cases, with three seconds of elapsed time shown on the horizontal scale from the initial impact to the right end of the graphs. The lighter lines indicate the subdivisions in seconds. As can be readily appreciated, the support system of the immediate invention (lower graph) more than doubled the resonance decay time compared to a traditional support (upper graph), with the upper graph decaying to zero in approximately one second and the lower graph decaying to zero in approximately two seconds.

It should be noted that the standard thickness of the synthetic films used for a typical head of the drum that is to be struck by a stick or mallet ranges upward from about twelve thousandths of an inch. In those embodiments where support straps are made from the drum head or from the same material as the drum head, use of a thicker film or adding additional plies of film allows customization of the strength and acoustical qualities of the straps as required for the particular application. By altering qualities of the straps, such as using thicker film, laminating plies of various numbers, or otherwise making the straps in a different width, length, or thickness, a stronger support may be made for heavier drums or acoustical isolation can be customized for a particular drum.

It is also important to note that the invention is not limited to use with only drums, but may be adapted to any acoustic instrument which relies on vibration to produce sound, and that when used with drums, it is not limited to drums only in an upright position, but can easily be applied to drums used in a horizontal plane such as a bass drum played with a standard bass drum pedal operated with the player's foot. It should be noted that a support for this application of the invention would require a stand different from the tripod support or other supports described in this patent. It could also be placed on various parts of the drum's shell.

While the invention has been shown and described with reference to a specific exemplary embodiment, it should be understood by those skilled in the art that various changes in form and detail may be made without departing from the spirit and scope of the invention, and that the invention should therefore only be limited according to the following claims, including all equivalent interpretation to which they are entitled.

I claim:

1. An acoustic instrument support system comprising three or more non-elastic straps each having an inner end rigidly secured to and extending outward radially from the instrument across a short gap to an outer end attached to a partially to fully circular support frame partially to fully encircling the instrument, wherein said support frame is spaced and isolated from the instrument except through said three or more straps of short radial span, and wherein said three or more straps provide support at least at opposite sides of the instrument and at least one location there-between.

2. The support system of claim 1 wherein said one or more straps is each comprised of an acoustically isolating material.

3. The support system of claim 2 wherein said material is acoustically isolating when not under tension.

4. The support system of claim 2 wherein said material is taken from the group including polyethylene-terephthalate, acetal, aramid fibers, polyamide, polyoxymethylene, polyester, polypropylene, and polyethylene.

5. The support system of claim 1 wherein said one or more straps each has a length, a width, and a thickness, said length measured from the instrument to the strap's outer end, along the strap, said width measured tangential to the instrument and perpendicular to said length, and said thickness measured perpendicular to said length and said width, and wherein the ratio of said width to said thickness is greater than approximately five to one.

6. The support system of claim 5 wherein the ratio of said length to said thickness is greater than approximately twenty to one.

7. The support system of claim 6 wherein the ratio of said length to said width is greater than approximately two to one.

8. The support system of claim 1 wherein said one or more straps each has a length, a width, and a thickness, said length measured from the instrument to the strap's outer end, along the strap, said width measured tangential to the instrument and perpendicular to said length, and said thickness measured perpendicular to said length and said width, and wherein the ratio of said length to said thickness is greater than approximately twenty to one.

9. The support system of claim 8 wherein the ratio of said length to said width is greater than approximately two to one.

10. The support system of claim 1 wherein said one or more straps each has a length, a width, and a thickness, said length measured from the instrument to the strap's outer end, along the strap, said width measured tangential to the instrument and perpendicular to said length, and said thickness measured perpendicular to said length and said width, and wherein the ratio of said length to said width is greater than approximately two to one.

11. The support system of claim 1 wherein the instrument has a thin-filmed percussion head, and wherein said one or more straps is each comprised of the same material as the percussion head.

12. The support system of claim 1 wherein the instrument has a thin-filmed percussion head, and wherein said one or more straps is integral with the percussion head.

13. The support system of claim 12 wherein the instrument has a thin-filmed percussion head, and wherein said one or more straps is each comprised of the percussion head.

14. The support system of claim 12 wherein the instrument is a drum, the percussion head is a drum head, and wherein said one or more straps is each an integral extension of the drum head.

15. An acoustic instrument support system comprising a plurality of non-elastic straps and a circular support ring;

said support ring encircling the instrument and spaced radially there-from;

said straps each having an inner end rigidly secured to and extending outward radially from the instrument across a short gap to an outer end comprising a fastener attached to said support ring;

wherein said support ring is isolated from the instrument except through said straps, and wherein said plurality of straps of short radial span provide support at least at opposite sides of the instrument and at least one location there-between.

16. The support system of claim 15 wherein said straps are equally spaced about the instrument.

17. The support system of claim 15 said inner ends are attached to the instrument on a first plane, and said support ring is disposed on a second plane separated from and substantially parallel to said first plane, and wherein said straps further extend from said inner ends at said first plan to said fasteners attached to said support ring at said second plane.

18. The support system of claim 17 wherein said straps are equally spaced about the instrument.

19. The support system of claim 18 wherein said support ring is disposed and configured for connection to a tripod drum stand.

20. The support system of claim 15 wherein said straps are comprised of a material taken from the group including polyethylene-terephthalate, acetal aramid fibers, polyamide, polyoxymethylene, polyester, polypropylene, and polyethylene.

21. The support system of claim 15 wherein said straps each have a flexible portion disposed between said attached inner and outer ends and having a length, a width, and a thickness, said length measured from said inner end to said outer end, said width measured tangential to the instrument, and said thickness measured perpendicular to said length and said width, and wherein the ratio of said width to said thickness is greater than approximately five to one.

22. The support system of claim 21 wherein the ratio of said length to said thickness is greater than approximately twenty to one.

23. The support system of claim 22 wherein the ratio of said length to said width is greater than approximately two to one.

24. A method for suspending an acoustic instrument from a circular support ring encircling the instrument and spaced radially outwardly there-from, said method comprising:

rigidly securing an inner end of each of a plurality of non-elastic straps to and substantially equally around the instrument, wherein said one or more straps provide support at least at opposite sides of the instrument and at least one location there-between;

extending each strap outwardly in a radial direction across a short gap to the support ring; and fastening an outer end of each strap to the support ring.

25. An acoustic instrument support system comprising three or more non-elastic straps each having an inner end rigidly secured to and extending radially outward from an instrument support element across a short gap to an outer end attached to a support frame surrounding the element, wherein said support frame is spaced and isolated from the element except through said three or more straps, wherein said three or more straps of short radial span provide support at least at opposite sides of the instrument and at least one location there-between, and wherein said element receives the acoustic instrument resting thereupon.

26. The support system of claim 25 wherein the instrument has a thin-filmed percussion head, and wherein said one or more straps is each comprised of the same material as the percussion head.

27. The support system of claim 25 wherein the element is a circular ring.

28. The support system of claim 25 wherein the element is a portion of a circular ring.

* * * * *